US005311100A

United States Patent [19]

Brain

[11] Patent Number: 5,311,100

[45] Date of Patent: May 10, 1994

[54] WATER-ACTIVATED SURVIVAL LAMP UNIT AND AN IMPROVED WATER-RESPONSIVE SWITCH THEREFOR

[75] Inventor: John E. Brain, Quebec, Canada

[73] Assignee: Errington John Enterprises Ltd., Quebec, Canada

[21] Appl. No.: 786,451

[22] Filed: Nov. 1, 1991

[30] Foreign Application Priority Data

Nov. 2, 1990 [CA] Canada ..... 2029235

[51] Int. Cl.[5] ..... H05B 37/00

[52] U.S. Cl. ..... 315/129; 441/89; 441/130; 340/604; 315/136; 315/362; 315/360

[58] Field of Search ..... 315/129, 360, 136, 362; 441/89, 130; 340/604

[56] References Cited

U.S. PATENT DOCUMENTS

| | | | |
|---|---|---|---|
| 3,278,921 | 10/1966 | Horino | 340/321 |
| 3,602,661 | 8/1971 | Liedberg | 200/61.05 |
| 3,621,276 | 11/1971 | Mitchell | 307/141 |
| 3,722,408 | 3/1973 | Fox et al. | 102/16 |
| 4,475,476 | 10/1984 | Howard | 441/89 |
| 4,502,044 | 2/1985 | Farris et al. | 340/604 |
| 4,523,913 | 6/1985 | Kaino | 441/89 |
| 4,714,914 | 12/1987 | Boe | 340/573 |
| 4,725,253 | 2/1988 | Politte | 441/130 |
| 5,034,847 | 7/1991 | Brain | 362/205 |
| 5,059,952 | 10/1991 | Wen | 340/604 |

FOREIGN PATENT DOCUMENTS

| | | | |
|---|---|---|---|
| 87788 | 6/1982 | Japan | 441/89 |
| 566409 | 12/1944 | United Kingdom | 441/89 |
| 2190254 | 11/1987 | United Kingdom | 441/89 |

*Primary Examiner*—Robert J. Pascal
*Assistant Examiner*—Michael B. Shingleton
*Attorney, Agent, or Firm*—Schweitzer, Cornman & Gross

[57] ABSTRACT

A water-activated survival lamp unit for mounting to a flotation device in proximity to the water line. The survival lamp unit comprises a hermetically sealed light transmissive housing in which are mounted a light source and a battery in an electrical circuit together. A water-responsive actuator is provided, including a pair of electric terminals extending outside the housing in a spaced apart relationship. The actuator is responsive to a momentary electrical path established between the terminals through a coherent body of water to close the electrical circuit between the battery and the light source for a predetermined time period largely exceeding the duration of the electrical path, thus causing timed actuation of the light source. Periodic water splashing of the electric terminals allows to reestablish at intervals the electric path, each time resetting the actuator which closes the electrical circuit for an additional time period.

15 Claims, 3 Drawing Sheets

WATER-ACTIVATED SURVIVAL LAMP UNIT AND AN IMPROVED WATER-RESPONSIVE SWITCH THEREFOR

FIELD OF THE INVENTION

The present invention relates to a water-activated survival lamp unit for mounting to a flotation device such as a life jacket or a life raft. More particularly, the invention relates to a survival lamp unit having an improved water-responsive switch which does not require a continuous contact with a coherent body of water for operating the light source of the survival lamp unit.

BACKGROUND OF THE INVENTION

Most recently developed survival lamp units for use on personal flotation devices, such as inflatable life vests, require a water-responsive switch closing an electric circuit between a battery and a light source when in contact with a coherent mass of water. A typical water-responsive switch comprises a pair of electric terminals impressed with a certain voltage potential. When in the dry state, the impedence between the terminals is very high and the current allowed to circulate is virtually nil. However, when wet, the impedence is dramatically reduced establishing an electrical path which sets a simple transistor circuit in the conduction state, closing the electric circuit between the battery and the light source.

A major drawback of this type of water-responsive switches is the requirement to maintain the electric terminals continually immersed in water to obtain a steady operation of the light source. Any discontinuance in the electrical path between the terminals will extinguish the light source. Consequently, when used on a life vest or on another type of flotation device, the water-responsive switch and the light source of the survival lamp unit must be physically separated to locate these components below and above the water line respectively, for a proper operation. This requirement complicates the construction of the life vest because the manufacturer must provide a routing for the cable interconnecting the two components, an underwater pocket to hold the water-responsive switch and in addition, the likelihood of lamp failure is increased because of possible leaks at the cable/component junctions.

OBJECT AND STATEMENT OF THE INVENTION

An object of the present invention is a survival lamp unit for use on an emergency flotation device, with a water-responsive switch which does not require a continuous immersion into a coherent mass of water to properly operate the survival lamp unit.

As embodied and broadly described herein, the invention provides a survival lamp unit for mounting to a flotation device above and in proximity to the water line, said survival lamp unit comprising:

a hermetically sealed light transmissive housing;

a light source mounted in said housing;

a battery mounted in said housing, said battery being electrically connected to said light source for supplying electrical energy thereto;

a water-responsive actuator in an electrical path that connects said battery and said light source for controlling an operation of said light source, said actuator including a sensing element extending outside said housing, said actuator being responsive to a momentary contact between said sensing element and a coherent body of water to actuate said light source during an operative cycle continuing over a predetermined time period that largely exceeds a duration of said momentary contact, upon expiration of said predetermined time period, said actuator terminating said operative cycle, whereby periodic water splashing of said housing allows to re-establish at intervals said momentary contact, each momentary contact occurrence triggering said actuator to actuate said light source during an additional operative cycle.

As embodied and broadly described herein, the invention also provides a water-actuated survival lamp unit for mounting to a flotation device above and in proximity to the water line, said survival lamp unit comprising:

a hermetically sealed light transmissive housing;

a light source mounted in said housing;

a battery mounted in said housing, said battery being in an electrical circuit with said light source for supplying electrical energy thereto;

a water-responsive actuator for controlling an operation of said light source, said actuator including:

a) a sensing element projecting outside said housing; and b) a switch in an electric path that connects said battery to said light source, said switch being operatively connected to said element and being responsive to a momentary contact between said sensing element and a coherent body of water to assume and continuously maintain a closed condition over a predetermined time period that largely exceeds a duration of said momentary contact, thereby enabling said light source to operate during said predetermined time period, at the expiration of said predetermined time period said switch assuming an opened condition to preclude operation of said light source whereby periodic water splashing of said housing allows to re-establish at intervals said momentary contact, each momentary contact occurrence triggering said switch to assume the closed condition for an additional predetermined time period.

As embodied and broadly described herein, the invention also provides a water-actuated survival lamp unit for mounting to a flotation device above and in proximity to the water line, said survival lamp unit comprising:

a hermetically sealed light transmissive housing;

a light source mounted in said housing;

a battery mounted in said housing, said battery being in an electrical circuit with said light source for actuating said light source when said electrical circuit assumes a closed condition, said light source being deactuated when said electrical circuit assumes an opened condition; and a water-responsive actuator including a pair of electric terminals extending outside said housing in a spaced apart relationship, said water-responsive actuator being responsive to a momentary electric path established between said terminals through a coherent body of water to close said electrical circuit for a predetermined time period that largely exceeds a duration of said electric path and maintains said light source continuously in operation during said predetermined time period, upon expiration of said predetermined time period said water-responsive actuator deactivating said light source, whereby periodic water splashing of said housing allows to re-establish at intervals said electric path, each electric path occurrence triggering said water-responsive actuator to effect closure of said electrical circuit for additional time period.

An important advantage of this arrangement is the possibility to mount all the components of the survival lamp unit into a single hermetically sealed container. Accordingly, the construction of the emergency flotation device is simplified since there is no longer a necessity to provide a cable routing and a pocket for the water-responsive actuator. In addition, the manufacturing costs of the survival lamp unit can also be somewhat reduced because the cable and the associated gasketing is eliminated.

Another important advantage of one preferred embodiment is the possibility to easily test the survival lamp unit without wetting or disassembly of the device. To effect the test procedure, it suffices to bridge the electric terminals of the water-responsive actuator to artificially establish therebetween the electrical path. This may actually be done by touching the terminals with a wet hand or with any other type of conductor that will reduce the impedence below the trigger level.

In a most preferred embodiment, the water-responsive actuator comprises a charge storage device, such as a capacitor, driving a current-controlled switch serially connected between the battery and the light source. In operation, the battery continuously impresses a certain voltage across terminals of the water-responsive actuator. When an electric path is established therebetween, the resulting electric current charges the capacitor and simultaneously commands closure of the current-controlled switch, turning on the light source. Discontinuance of the electric path between the terminals will not result in an immediate opening of the current-controlled switch because the capacitor will continue to supply the current required for the switch to remain in the closed condition. Ultimately, the current-controlled switch will open when the capacitor is depleted, deactivating the light source. To provide a more or less steady operation of the light source, it suffices to momentarily reestablish the electrical path between the terminals of the water-responsive actuator in order to regenerate the charge of the capacitor. In practise, this occurs when the survival lamp unit is mounted on an inflatable life vest or on a life raft, in proximity to the water line. The survival lamp unit is subjected to a continuous water splashing permitting to regenerate the charge of the capacitor on a regular basis, thus maintaining the light source in operation.

In a variant, a fluid absorbent composition may be provided between the terminals so when wet, it will provide a continuous electrical path therebetween. This embodiment is particularly advantageous for applications which require the survival lamp unit to operate when the device is raised considerably above the water line or so located that it cannot be reached by water splashes. A practical example is a situation where a person wearing a life vest is lifted from the water into a life raft. Without the fluid absorbent composition, the survival lamp on the life vest will cease to operate shortly thereafter.

In another variant, the survival lamp unit is provided with a flashing light source. The advantage of this arrangement resides in the reduction of the power consumption of the light source, thus allowing to use a brighter light source without the necessity to increase the capacity of the battery.

DESCRIPTION OF A PREFERRED EMBODIMENT

Figure 1:
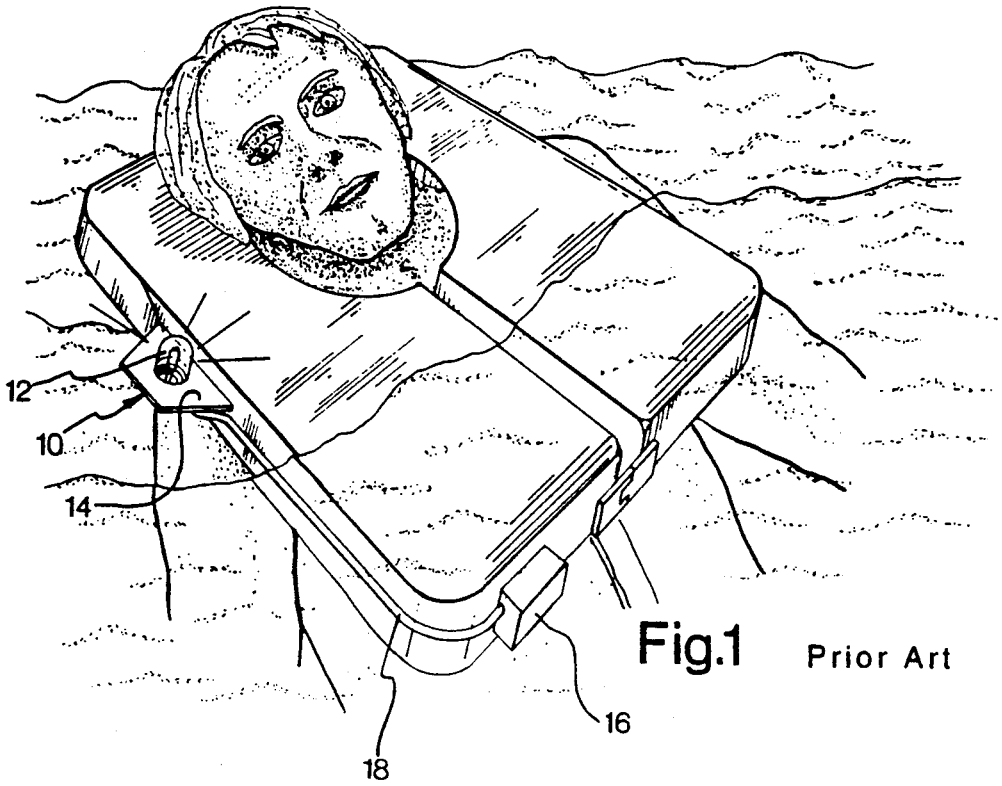
Fig.1 Prior Art
FIG. 1 is a perspective view of a life vest equipped with a prior art survival lamp unit.

FIG. 1 depicts a person in the water maintained afloat by a life vest provided with a prior art survival lamp unit. The survival lamp unit is identified comprehensively by the reference numeral 10 and it comprises a light source 12 mounted to a flexible tab 14 on the life vest, operated by a dry-cell battery (not shown in the drawings) mounted in a water-proof housing 16 and connected to the light source 12 by an electrical cable 18. The housing 16 also receives a water-responsive switch whose function is to automatically actuate the light source 12 by closing the circuit with the battery when the housing 16 is immersed in an electro-conductive fluid such as water.

To operate the light source 12 in a steady fashion, the water-responsive switch in the housing 16 must be continually submerged, which necessitates to locate the housing 16 in the lower portion of the life vest, below the water line. On the other hand, the light source 12 must at all times remain above the water line to be visible, necessitating a physical separation of two components of the survival lamp unit 10, which is undesirable because it requires a special life vest construction.

Figure 2:
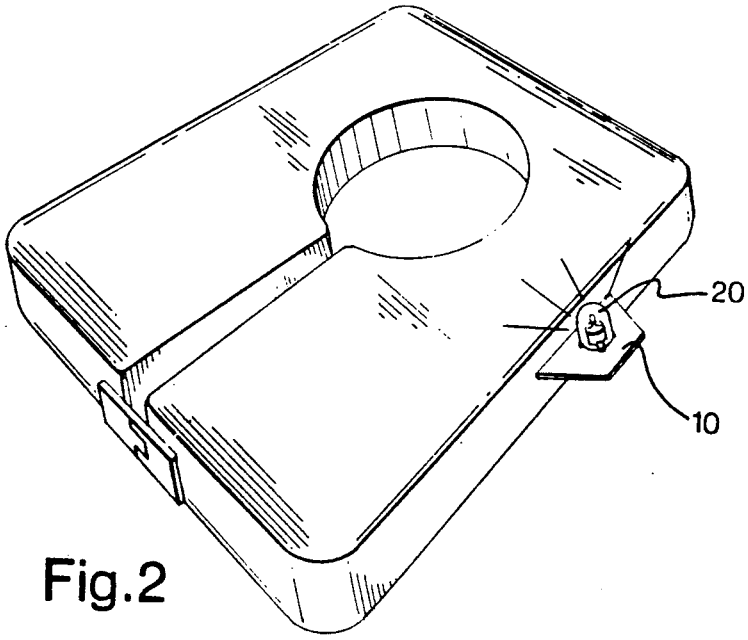
FIG. 2 is a perspective view of a life vest provided with a survival lamp unit according to the present invention.
Figure 3:
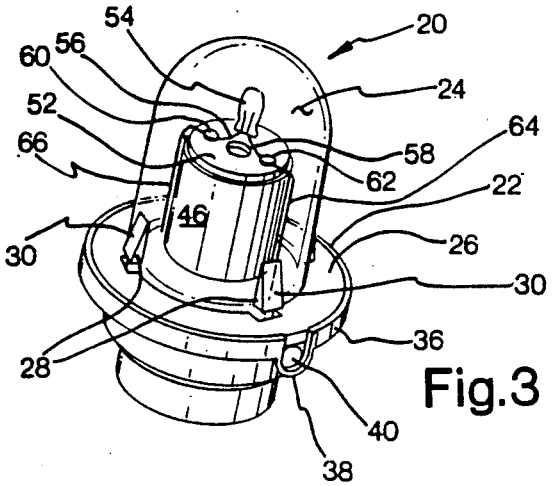
FIG. 3 is a perspective view of the survival lamp unit according to the invention.

The survival lamp unit according to the invention, depicted in FIG. 2 is shown attached to a life vest. The survival lamp unit is a considerable improvement over the prior art device described above because all the components of the lamp unit are mounted into a single housing. Accordingly, the sole requirement for mounting the survival lamp unit to the life vest is to provide the tab 10 or any other equivalent supporting structure, without the necessity of a pocket to hold the battery and the fluid sensing switch and a routing for an electrical cable.

The structure of the survival lamp unit according to the invention will now be described in FIGS. 3 to 7. The survival lamp unit, identified comprehensively by the reference numeral 20, comprises a hermetically sealed housing 22 made preferably of plastic material including a dome-shaped transparent cover 24 terminating with an outwardly extending flange 26. Immediately above the flange 26 are provided a plurality of equidistant locking teeth 28 which serve in conjunction with the flange 26 to maintain the survival lamp unit 20 captive on a flexible sheet-like material such as the mounting tab 10 of a life vest, as it will be explained in detail hereinafter. Each locking tooth 28 is shaped to present a ramp surface 30 terminating with a locking face 32 in a spaced apart relationship and parallel to the flange 26.

The bottom portion of the housing 22 includes a cup shaped opaque base 34 displaying a radially outwardly extending socket 36 receiving in a tight fit the flange 26. The continuity of the circular configuration of the socket 36 is disrupted at a single location, for providing a U-shaped pocket 38 to receive an electric terminal 40. The bottom face of the cup-shaped base 34 is disc-shaped displaying a central opening 42 receiving the projecting terminal 44 of a dry-cell lithium type battery 46.

All the mating surfaces between the dome-shaped cover 24 and the cup-shaped base 34 are permanently sealed with epoxy glue in order to render the housing 22 water-proof. More specifically, epoxy glue is applied between the flange 26 and the socket 36 and peripherally around the terminals 40 and 44. Care should be taken not to entirely encapsulate the terminals so that at least a portion of their metallic surface remains exposed to the exterior.

Figure 4:
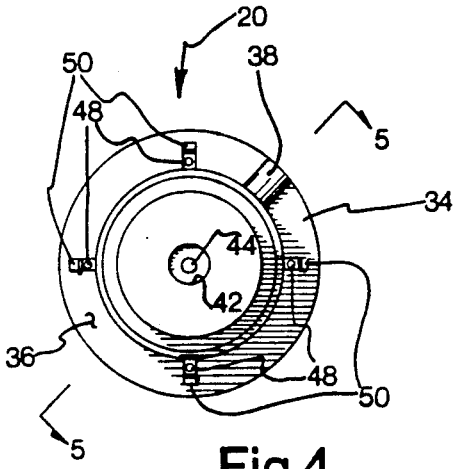
FIG. 4 is a bottom plan view of the survival lamp unit according to the invention.
Figure 5:
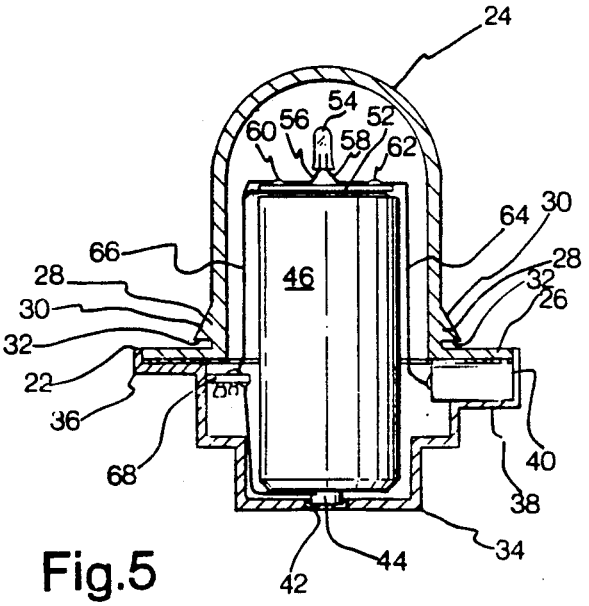
FIG. 5 is a sectional view taken along lines 5—5 in FIG. 4.

During the manufacturing process of the survival lamp unit 20, it may be desirable to permit the lamp unit to be handled before the epoxy glue has been cured, in occurrence for placing the lamp unit in individual packages immediately after the assembly procedure has been completed. At this end, a positive locking system is provided between the transparent cover 24 and the base member 34 preventing any relative movement between these components, allowing the epoxy glue to cure even during handling of the lamp unit. The positive mechanical locking system, best shown in FIG. 4, is a series of locking teeth 48 downwardly projecting from the flange 26 and fitting in individual locking recesses 50 formed on the socket 36. The locking teeth 48 are of known construction, each tooth comprising a camming face and ending with a locking surface, similar to the configuration of the locking teeth 28 described above. During the installation of the transparent cover 24 on the cup-shaped base member 34 the locking teeth 48 yield somewhat during the penetration of the flange 26 in the socket 36 as a result of their camming surfaces coming in sliding contact with the edges of the respective recesses 50. Once the locking faces of the teeth 48 have cleared the edge of the respective recesses 50, the teeth recover their original position preventing an unwanted removal of the cover 24.

The battery 46, in addition to providing the electrical power for operating the survival lamp unit 20, constitutes a supporting structure for some internal components of the device. The battery 46 is rigidly held in the housing 22 by virtue of the adhesive mounting of the terminal 44 in the opening 42. Accordingly, the battery 46 is prevented to longitudinally move or tilt in the housing 22. On the top end of the battery 46, constituting the other terminal of the battery which has a planar configuration, is seated an insulating disc 52 carrying a light source 54 such as a small incadescent lamp. The disc 52 is essentially a lamination, comprising a plastic material core sandwiched between two thin copper layers, of a type similar used for making circuit boards. The copper layers are all etched except at two small spots on the top surface of the disc 52 so that the terminals of the light source 54, numbered 56 and 58 respectively may be soldered thereto, at 60 and 62. A rigid conductor 64 is connected between point 62 and the terminal 40 and a similar rigid conductor 66 is pulled between the point 60 and a circuit board (not shown in the drawings) containing all the solid-state electronic components of the lamp unit and being rigidly mounted within the cup-shaped base member 34. It will be appreciated that in addition to their current channelling function, the conductors 64 and 66, along with the disk 52, form a strap which further secures the battery against movement in the housing 22.

Figure 7:
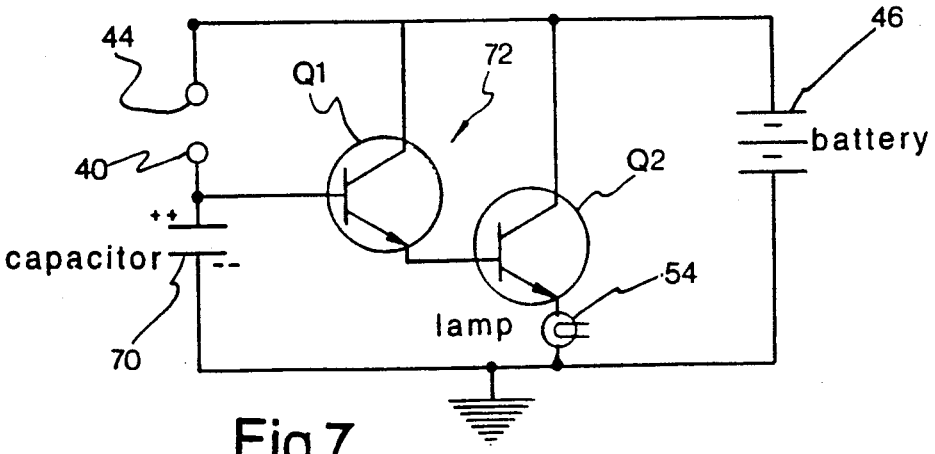
FIG. 7 is a schematical diagram of the electrical circuit of the survival lamp unit according to the invention.

The operation of the survival lamp unit 20 will now be described in connection with FIG. 7 which illustrator a schematical diagram of the light unit electrical circuit. At all times, the battery impresses a certain voltage across outside terminals 40 and 42. The impedence between these terminals being virtually infinite, no current is allowed to circulate and the battery remains in a fully charged condition. When an electric path is established between the terminals 40 and 44, even be it small, such as when dipping the terminals into a coherent body of water, the resulting electric current passing between the terminals through the fluid medium will charge a capacitor 70, simultaneously turning on a solid-state current-controlled switch 72 comprising a pair of cascaded transistors Q1 and Q2. Current flowing through the base terminal of Q1 sets the transistor in a conduction state which injects current in the base terminal of Q2, causing Q2 to conduct, whereby an electrical current can flow from the battery 46 through the lamp 54. If the electrical path between the terminals 40 and 44 is disrupted, the capacitor 70 will nevertheless maintain the switch 72 on by supplying enough base current through transistor Q1 to maintain same in the conduction state. Ultimately, the switch 72 will open when the capacitor will be depleted.

When fully charged, the capacitor 70 may provide several minutes of running time for the switch 72. The circuit may be reactivated for an additional time period by momentarily establishing an electric path between the terminals 40 and 44 in order to charge again the capacitor 70.

By enlarging the size of the capacitor, the self-sustained running time of the survival lamp unit 20 is increased at the expense of a longer capacitor charging time. For applications where the electrical path between the terminals 40 and 44 can be maintained for longer time periods, in the order of several seconds, a larger capacitor can advantageously be used to space the recharging cycles necessary to maintain the lamp 54 continuously in operation.

When the life vest is worn by an individual in the water, the survival lamp unit 20 extends slightly above the water line, typically a few inches. When the individual moves around slightly, water is projected against the housing 22 of the survival lamp unit 20, establishing the electrical path between the terminals 40 and 44. As explained earlier, this electrical path occurring momentarily will actuate the light source 54 for a predetermined time period. However, considering that the water splashing will project water periodically on the housing 22, this electrical path will be reestablished at intervals, in the overall, allowing the light source 54 to operate in a continuous fashion.

When not in use, the survival lamp unit can be very easily tested, simply by creating artificially the electrical path between the terminals 40 and 44. This may be achieved by touching with a wet hand both terminals simultaneously or with any other conductor device. The light source 54 will then be actuated for a predetermined period of time and when the capacitor 70 is discharged, the light source will turn off automatically. This is particularly advantageous because the lamp unit may be tested very rapidly without the necessity of opening the housing 22 nor performing complex manipulations. When a large number of lamp units must be tested, this feature permits to complete rapidly the testing procedure, easily identifying the faulty units.

Referring back to FIG. 2, the survival lamp unit 20 is installed on the tab 10 of a life vest simply by sliding the cover 24 into the circular opening (not shown in the drawings) normally provided on the tab 10. When the sheet-like material of the tab 10 reaches the fingers 28, the ramp surfaces 30 thereof spread outwardly the material allowing the transparent cover 24 to further penetrate in the tab, until the sheet-like material slides past the locking fingers 28, abuting against the flange 26 and recovering its original shape, whereby remaining captive between the flange 26 and the locking fingers 28.

Figure 6:
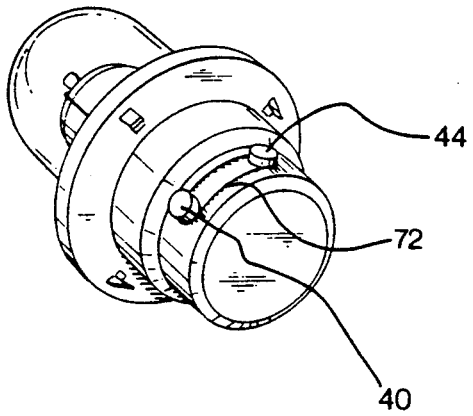
FIG. 6 is a perspective view of the survival lamp unit according to a variant.

In a variant illustrated in FIG. 6, the location of the terminals 40 and 44 has been changed, the terminals now being located closer to one another and a string of fluid absorbent medium 72 looped around the terminals in physical contact therewith. The string of fluid absorbent medium 72 may be of any composition such as cotton, wool batt or any other type of fabric having the ability to absorb and retain water between its fibers. When the terminals 40 and 44 are immersed into an electro-conductive fluid, and then withdrawn therefrom, the fluid absorbing medium 72 will maintain the electrical path between the terminals through the small quantity of fluid remaining in the material. In this embodiment, the capacitor 70 is maintained in a fully charged condition until the fluid absorbing medium is dry so that the light source 54 may continue to operate for long time periods without the necessity of periodically recharging the capacitor.

In another variant, the survival lamp unit 20 may be provided with a flashing-light source which has a smaller power consumption comparatively to a continuous light source, whereby allowing to use a brighter light without increasing the capacity of the battery.

The circuit to obtain the light flashing will not be described because it is of known construction. Suffice it to say that it is incorporated in the diagram of FIG. 7, serially between Q2 and the light source 54. The flashing circuit is actuated when Q2 is set in the conduction state.

The above description of preferred embodiments of this invention should not be interpreted in any limiting manner since these embodiments may be refined and varied in several ways without departing from the spirit of the invention. The scope of the invention is defined in the annexed claims.

The embodiments of the invention in which an exclusive property or privilege is claimed are defined as follows:

1. A survival lamp unit for mounting to a flotation device above and in proximity to the water line, said survival lamp unit comprising:

a hermetically sealed light transmissive housing;

a light source mounted in said housing;

a battery mounted in said housing, said battery being electrically connected to said light source for supplying electrical energy thereto; and a water-responsive actuator in an electrical path that connects said battery and said light source for controlling an operation of said light source, said actuator including a sensing element extending outside said housing, said actuator being responsive to a momentary contact between said sensing element and a coherent body of water to actuate said light source during an operative cycle continuing over a predetermined time period that largely exceeds a duration of said momentary contact, upon expiration of said predetermined time period said actuator terminating said operative cycle, whereby periodic water splashing of said housing allows to re-establish at intervals said momentary contact, each momentary contact occurrence triggering said actuator to actuate said light source during an additional operative cycle.

2. A survival lamp unit, as defined in claim 1, wherein said actuator comprises:

a charge storage device in operative relationship with said battery to store electrical charges supplied from said battery upon occurence of said momentary electrical path;

a current-controlled switch in said electrical circuit for closing same in response to electrical current supplied thereto by said charge storage device.

3. A survival lamp unit as defined in claim 2, wherein said charge storage device is a capacitor.

4. A survival lamp unit as defined in claim 2, wherein said current-controlled switch comprises transistor means including a base terminal in current receiving relationship with said charge storage device.

5. A survival lamp unit as defined in claim 4, wherein said current controlled switch comprises a pair of transistors in cascade connection.

6. A survival lamp unit as defined in claim 1, comprising a water-absorbent medium between said terminals proving a continuous electrical path therebetween when wet.

7. A survival lamp unit as defined in claim 6, wherein said water absorbent medium has a string-like configuration.

8. A survival lamp unit as defined in claim 1, wherein said electric terminals are exposed outside said housing permitting to artificially establish an electric path therebetween to test said lamp unit.

9. A water-actuated survival lamp unit for mounting to a flotation device above and in proximity to the water line, said survival lamp unit comprising:

a hermetically sealed light transmissive housing;

a light source mounted in said housing;

a battery mounted in said housing, said battery being in an electrical circuit with said light source for actuating said light source when said electrical circuit assumes a closed condition, said light source being deactuated when said electrical circuit assumes an opened condition;

a water-responsive actuator including a pair of electric terminals extending outside said housing in a spaced apart relationship, said water-responsive actuator being responsive to a momentary electric path established between said terminals through a coherent body of water to close said electrical circuit for a predetermined time period that largely exceeds a duration of said electric path and maintain said light source continuously in operation during said predetermined time period, upon expiration of said predetermined time period said water-responsive actuator deactivating said light source, whereby periodic water splashing of said housing allows to re-establish at intervals said electric path, each electric path occurrence triggering said closure of said electrical circuit for an additional time period.

10. A survival lamp unit as defined in claim 1, wherein said sensing element comprises a pair of electric terminals in a spaced apart relationship projecting outside said casing, said contact allowing a momentary electric path to be established between said terminals through the coherent body of water, said momentary electric path causing said actuator to initiate said operative cycle.

11. A flotation device comprising the survival lamp unit of claim 1.

12. A life vest comprising the survival lamp unit of claim 1.

13. A life vest as defined in claim 12, wherein said survival lamp unit is mounted to an upper portion of said life vest.

14. A water-actuated survival lamp unit for mounting to a flotation device above and in proximity to the water line, said survival lamp unit comprising:

a hermetically sealed light transmissive housing;

a battery mounted in said housing, said battery being in an electrical circuit with said light source for supplying electrical energy thereto;

a water-responsive actuator for controlling an operation of said light source, said actuator including:

a) a sensing element projecting outside said housing;

b) a switch in an electric path that connects said battery to said light source, said switch being operatively connected to said sensing element and being responsive to a momentary contact between said sensing element and a coherent body of water to assume and continuously maintain a closed condition over a predetermined time period that largely exceeds a duration of said momentary contact, thereby enabling said light source to operate during said predetermined time period, at the expiration of said predetermined time period said switch assuming an opened condition to preclude operation of said light source, whereby periodic water splashing of said housing allows to re-establish at intervals said momentary contact, each momentary contact occurrence triggering said switch to assume the closed condition for an additional predetermined time period.

15. A water-actuated survival lamp unit as defined in claim 14, wherein said sensing element includes a pair of electric terminals projecting outside said housing, said switch being responsive to a momentary electric path between said terminals to assume said closed condition over said predetermined time period.

* * * * *

UNITED STATES PATENT AND TRADEMARK OFFICE

CERTIFICATE OF CORRECTION

PATENT NO. : 5,311,100

DATED : May 10, 1994

INVENTOR(S) : John Errington Brain

It is certified that error appears in the above-indentified patent and that said Letters Patent is hereby corrected as shown below:

Column 8, line 14, "claim 1" should read —claim 10—.
Column 8, line 32, "claim 1" should read —claim 10—.
Column 8, line 39, "claim 1" should read —claim 10—.

Signed and Sealed this

Fourth Day of June, 1996

Bruce Lehman

*Attest:*

BRUCE LEHMAN

*Attesting Officer*

*Commissioner of Patents and Trademarks*

US005311100B1

REEXAMINATION CERTIFICATE (4058th)

United States Patent [19] [11] B1 5,311,100

Brain [45] Certificate Issued Apr. 25, 2000

[54] WATER-ACTIVATED SURVIVAL LAMP UNIT AND AN IMPROVED WATER-RESPONSIVE SWITCH THEREFOR

[75] Inventor: John E. Brain, Quebec, Canada

[73] Assignee: Errington John Enterprises Ltd., Kirkland, Canada

Reexamination Request:
No. 90/004,292, Jun. 28, 1996

Reexamination Certificate for:

| | |
|---|---|
| Patent No.: | **5,311,100** |
| Issued: | **May 10, 1994** |
| Appl. No.: | **07/786,451** |
| Filed: | **Nov. 1, 1991** |

Certificate of Correction issued Jun. 4, 1996.

[30] Foreign Application Priority Data

Nov. 2, 1990 [CA] Canada ..... 2029235

[51] Int. Cl.[7] ..... H05B 37/00

[52] U.S. Cl. ..... 315/129; 315/136; 315/362; 315/360; 441/89; 441/130; 340/604

[58] Field of Search ..... 315/129, 360, 315/136, 362; 441/89, 130; 340/604

[56] References Cited

U.S. PATENT DOCUMENTS

| | | | |
|---|---|---|---|
| 3,278,921 | 10/1966 | Horino | 340/235 |
| 3,621,276 | 11/1971 | Mitchell | 307/141 |
| 4,408,193 | 10/1983 | Millen | 340/556 |
| 5,034,847 | 7/1991 | Brain | 362/205 |

FOREIGN PATENT DOCUMENTS

| | | | |
|---|---|---|---|
| 57-87788 | 6/1982 | Japan | 441/89 |
| 566409 | 12/1944 | United Kingdom | 441/89 |

*Primary Examiner*—Michael B Shingleton

[57] ABSTRACT

A water-activated survival lamp unit for mounting to a flotation device in proximity to the water line. The survival lamp unit comprises a hermetically sealed light transmissive housing in which are mounted a light source and a battery in an electrical circuit together. A water-responsive actuator is provided, including a pair of electric terminals extending outside the housing in a spaced apart relationship. The actuator is responsive to a momentary electrical path established between the terminals through a coherent body of water to close the electrical circuit between the battery and the light source for a predetermined time period largely exceeding the duration of the electrical path, thus causing timed actuation of the light source. Periodic water splashing of the electric terminals allows to reestablish at intervals the electric path, each time resetting the actuator which closes the electrical circuit for an additional time period.

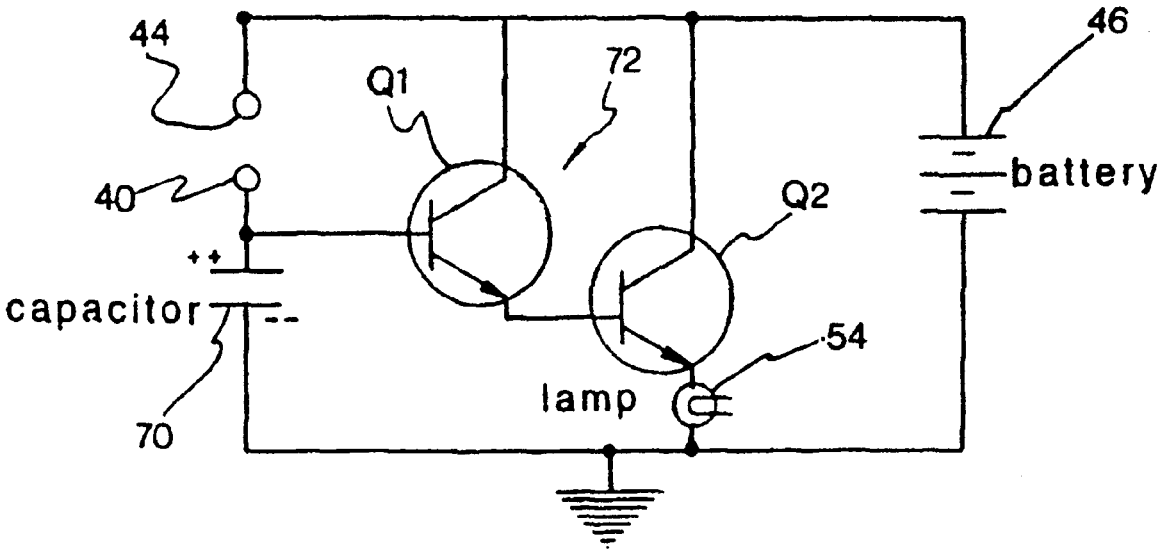

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 9 and 11–15 are cancelled.

Claim 10 is determined to be patentable as amended.

Claims 2–8, dependent on an amended claim, are determined to be patentable.

New claims 16–19 are added and determined to be patentable.

10. A survival lamp unit as defined in claim [1] *16*, wherein said sensing element comprises a pair of electric terminals in a spaced apart relationship projecting outside said casing, said contact allowing a momentary electric path to be established between said terminals through the coherent body of water, said momentary electric path causing said actuator to initiate said operative cycle.

*16. A survival lamp unit for mounting to a flotation device above and in proximity to the water line, said survival lamp comprising:*

*a hermetically sealed light transmissive housing;*

*a light source mounted in said housing;*

*a battery mounted in said housing, said battery being electrically connected to said light source for supplying electrical energy thereto; and*

*a water-responsive actuator in an electrical path that connects said battery and said light source for controlling an operation of said light source, said actuator including a sensing element extending outside said housing, said actuator being responsive to a momentary contact between said sensing element and a coherent body of water to actuate said light source during an operative cycle continuing over a predetermined time period that largely exceeds a duration of said momentary contact, and including means for initiating a new operative cycle by a subsequent momentary contact between said sensing element and a coherent body of water irrespective of whether said subsequent momentary contact occurs during or subsequent to a prior operative cycle.*

*17. A water-actuated survival lamp for mounting to a flotation device above and in proximity to the water line, said survival lamp unit comprising:*

*a hermetically sealed light transmissive housing;*

*a light source mounted in said housing;*

*a battery mounted in said housing, said battery being in an electrical circuit with said light source for actuating said light source when said electrical circuit assumes a closed condition, said light source being deactuated when said electrical circuit assumes an opened condition;*

*a water-responsive actuator including a pair of electric terminals extending outside said housing in a spaced apart relationship, said water-responsive actuator being responsive both to a first momentary electric path established between said terminals through a coherent body of water to close said electrical circuit for a predetermined time period that largely exceeds a duration of said electric path and maintain said light source continuously in operation during said predetermined time period, upon expiration of said predetermined time period said water-responsive actuator deactivating said light source, and responsive to a subsequent momentary electric path established between said terminals through a coherent body of water to reactivate said light source for a subsequent predetermined time period irrespective of whether said light source is operating at the time of said subsequent momentary electric path.*

*18. A survival lamp unit for mounting to a flotation device above and in proximity to the water line, said survival lamp comprising:*

*a hermetically sealed housing having at least a portion thereof being light-transmissive;*

*a light source mounted in said housing;*

*a battery mounted in said housing and connected to said light source for supplying energy thereto;*

*a water responsive actuator in an electrical path between said battery and said light source for controlling operation of the light source, comprising a sensing element extending exterior of said housing responsive to momentary contact between the sensing element and a coherent body of water and means for actuating said light source for an operative cycle of a predetermined time period largely exceeding a duration of said momentary contact, said actuating means further including means for resetting said actuating means for a new operative cycle of said predetermined time period upon a subsequent momentary contact between the sensing element and a coherent body of water occurring during or after a prior operative cycle.*

*19. A survival lamp unit for mounting to a flotation device above and in proximity to the water line, said survival lamp unit comprising:*

*a hermetically sealed light transmissive housing;*

*a light source mounted in said housing;*

*a battery mounted in said housing, said battery being electrically connected to said light source for supplying electrical energy thereto; and*

*a water-responsive actuator in an electrical path that connects said battery and said light source for controlling an operation of said light source, said actuator including a sensing element extending outside said housing, said actuator being responsive to a momentary contact between said sensing element and a coherent body of water to actuate said light source during an operative cycle continuing over a predetermined time period that largely exceeds a duration of said momentary contact, upon expiration of said predetermined time period said actuator terminating said operative cycle, said sensing element comprising a pair of electric terminals in a spaced apart relationship projecting outside said casing and a string-like absorbent medium between said terminals, said contact allowing a momentary electric path to be established between said terminals through the coherent body of water, said momentary electric path causing said actuator to initiate said operative cycle.*

* * * * *